US009657377B2

(12) United States Patent
Kim et al.

(10) Patent No.: US 9,657,377 B2
(45) **Date of Patent: *May 23, 2017**

(54) ALUMINUM ALLOY AND PRODUCTION METHOD THEREOF

(75) Inventors: Shae-Kwang Kim, Seoul (KR); Young-Ok Yoon, Incheon (KR); Jeong-Ho Seo, Seoul (KR)

(73) Assignee: KOREA INSTITUTE OF INDUSTRIAL TECHNOLOGY, Cheonan-si, Chungcheongnam-do (KR)

( * ) Notice: Subject to any disclaimer, the term of this patent is extended or adjusted under 35 U.S.C. 154(b) by 401 days.

This patent is subject to a terminal disclaimer.

(21) Appl. No.: 14/119,088

(22) PCT Filed: May 16, 2012

(86) PCT No.: PCT/KR2012/003846

§ 371 (c)(1),
(2), (4) Date: Feb. 13, 2014

(87) PCT Pub. No.: WO2012/161461

PCT Pub. Date: Nov. 29, 2012

(65) Prior Publication Data

US 2014/0199205 A1 Jul. 17, 2014

(30) Foreign Application Priority Data

May 20, 2011 (KR) ..... 10-2011-0048191

(51) Int. Cl.
*C22C 21/08* (2006.01)
*B22D 21/04* (2006.01)
(Continued)

(52) U.S. Cl.
CPC ..... *C22C 21/08* (2013.01); *B22D 21/04* (2013.01); *C22C 1/026* (2013.01); *C22C 21/02* (2013.01);
(Continued)

(58) Field of Classification Search
CPC ..... B22D 21/04; C22C 1/026; C22C 21/02; C22C 21/08; C22C 21/12; C22C 21/14;
(Continued)

(56) References Cited

U.S. PATENT DOCUMENTS

2012/0115708 A1* 5/2012 Han ..... C22C 1/1036 501/153

FOREIGN PATENT DOCUMENTS

| | | | |
|---|---|---|---|
| JP | 0657860 | B2 | 8/1994 |
| JP | 06-299263 | A | 10/1994 |
| JP | 07-207363 | A | 8/1995 |

OTHER PUBLICATIONS

Y. Tsunekawa; et al; "Application of ultrasonic vibration to in situ MMC process by electromagnetic melt stirring", Materials and Design, vol. 22, Issue 6, pp. 467-472, Sep. 2001.
(Continued)

*Primary Examiner* — Lois Zheng
(74) *Attorney, Agent, or Firm* — Ladas & Parry LLP

(57) ABSTRACT

Provided are an aluminum alloy and a production method thereof. In accordance with an embodiment, an aluminum-based mother material is melted to form a molten metal. An additive including silicon oxide is added to the molten metal. At least a portion of the silicon oxide is exhausted in the molten metal. The molten metal is cast.

13 Claims, 12 Drawing Sheets

(51) Int. Cl.

| | |
|---|---|
| ***C22C 1/02*** | (2006.01) |
| ***C22C 21/02*** | (2006.01) |
| ***C22C 21/12*** | (2006.01) |
| ***C22C 21/14*** | (2006.01) |
| ***C22C 21/16*** | (2006.01) |
| ***C22F 1/043*** | (2006.01) |
| ***C22F 1/047*** | (2006.01) |
| ***C22F 1/057*** | (2006.01) |
| *B22C 21/04* | (2006.01) |

(52) U.S. Cl.
CPC ..... *C22C 21/12* (2013.01); *C22C 21/14* (2013.01); *C22C 21/16* (2013.01); *C22F 1/043* (2013.01); *C22F 1/047* (2013.01); *C22F 1/057* (2013.01)

(58) Field of Classification Search
CPC ..... C22C 21/16; C22F 1/043; C22F 1/047; C22F 1/057
See application file for complete search history.

(56) References Cited

OTHER PUBLICATIONS

International Search Report mailed Dec. 3, 2012; PCT/KR2012/003846.

* cited by examiner

Al ⟷ 7.5μm

Si ⟷ 7.5μm

ALUMINUM ALLOY AND PRODUCTION METHOD THEREOF

BACKGROUND

The present disclosure relates to an aluminum alloy and a production method thereof.

In aluminum (Al) alloys, silicon (Si) is one of main alloy elements following magnesium. For example, an aluminum-silicon (Al—Si)-based alloy may be used as a casting material or a 4000 series wrought material on the classification derived from the US aluminum association. Moreover, an aluminum-magnesium-silicon (Al—Mg—Si)-based alloy is used as a casting material or a 6000 series wrought alloy.

In a casting material, silicon may be used in producing an alloy having high fluidity or easy filling of molten metal or an alloy having less casting cracks. Although silicon is added in an excessive amount to an aluminum molten metal, it allows the molten metal to be maintained in a good state almost without an increase in viscosity of the molten metal or oxidation tendency, and referring to the phase diagram shown in FIG. 9, silicon may easily refine grains through modifications of primary silicon and eutectic silicon. In such aluminum alloys, silicon is typically added in the form of pure silicon.

SUMMARY

The present disclose provides a method of producing an aluminum alloy containing silicon using silicon oxide that is more economical than pure silicon, and an aluminum alloy produced by the same. The above subject matter is only exemplary, and the scope of the present disclosure is not limited by the subject matter.

In accordance with an exemplary embodiment, there is provided a method of producing an aluminum alloy. An aluminum-based mother material is melted to form a molten metal. An additive including silicon oxide is added to the molten metal. At least a portion of the silicon oxide is exhausted in the molten metal. The molten metal is cast.

The exhausting may be performed such that the substantial entire portion of the silicon oxide does not remain in the molten metal.

In the exhausting, the silicon oxide is decomposed into silicon, and at least a portion of the silicon may be distributed in an aluminum matrix of the aluminum alloy.

The exhausting may be performed such that oxygen generated by decomposition of the silicon oxide is removed from the molten metal. The oxygen may be removed in the form of gas through a surface of the molten metal.

The exhausting may include stirring an upper portion of the molten metal. The stirring may be performed in a state that the surface of the molten metal is exposed to atmosphere. The stirring may be performed at an upper layer portion from a surface of the molten metal to a point which is not more than 20% of a total depth of the molten metal.

The mother material may include aluminum or an aluminum alloy.

The mother material may include an aluminum-magnesium alloy, the silicon oxide may be decomposed by the exhausting to generate silicon, and at least a portion of the silicon may react with magnesium in the molten metal to form a magnesium-silicon compound. The magnesium-silicon compound may include $Mg_2Si$.

In accordance with another exemplary embodiment, there is provided a method of producing an aluminum alloy. An aluminum-based mother material is melted to form a molten metal. An additive including silicon oxide is added to the molten metal. The substantial entire portion of the silicon oxide is decomposed in the molten metal to remain silicon in the molten metal and remove oxygen from the molten metal. The molten metal is cast such that at least a portion of the silicon is distributed in an aluminum matrix and the silicon oxide does not substantially remain.

In accordance with yet another exemplary embodiment, there is provided an aluminum alloy produced by any one of the above-described producing methods.

The aluminum-based mother material may include an aluminum-magnesium alloy, and a magnesium-silicon compound formed by casting without an additional heat treatment may exist in an aluminum matrix of the aluminum alloy.

A silicon or magnesium-silicon compound may exist in the aluminum matrix, and the silicon component in the silicon or magnesium-silicon compound may be decomposed and supplied from silicon oxide added to the molten metal when alloy casting.

BRIEF DESCRIPTION OF THE DRAWINGS

Exemplary embodiments can be understood in more detail from the following description taken in conjunction with the accompanying drawings, in which.

DETAILED DESCRIPTION OF EMBODIMENTS

Hereinafter, specific embodiments will be described in detail with reference to the accompanying drawings.

Hereinafter, the present invention will be described in detail by explaining preferred embodiments of the invention with reference to the attached drawings. The present disclosure may, however, be embodied in many different forms and should not be construed as being limited to the embodiments set forth herein; rather, these embodiments are provided so that this disclosure will be thorough and complete, and will fully convey the concept of the invention to those skilled in the art. Further, the present invention is only defined by scopes of claims.

In embodiments of the present disclosure, aluminum may indicate pure aluminum. Such pure aluminum may, however, further include an impurity (hereinafter referred to as an "evitable impurity) which is not intentionally added but is inevitably contained in the course of production although not particularly mentioned in the description.

In embodiments of the present disclosure, the term 'aluminum alloy' may indicate an alloy in which one or more additive elements are added to aluminum that is a main element. Such an aluminum alloy may, however, further include an evitable impurity in addition to the main element and additive elements although not particularly mentioned.

In embodiments of the present disclosure, an aluminum alloy containing silicon may indicate an alloy in which at least silicon is added as an additive to aluminum that is a main element. For example, the aluminum alloy containing silicon may include an aluminum-silicon (Al—Si)-based alloy, an aluminum-magnesium-silicon (Al—Mg—Si)-based alloy, an aluminum-silicon-copper (Al—Si—Cu)-based alloy, an aluminum-copper-magnesium-silicon (Al—Cu—Mg—Si)-based alloy, and the like.

Figure 1:
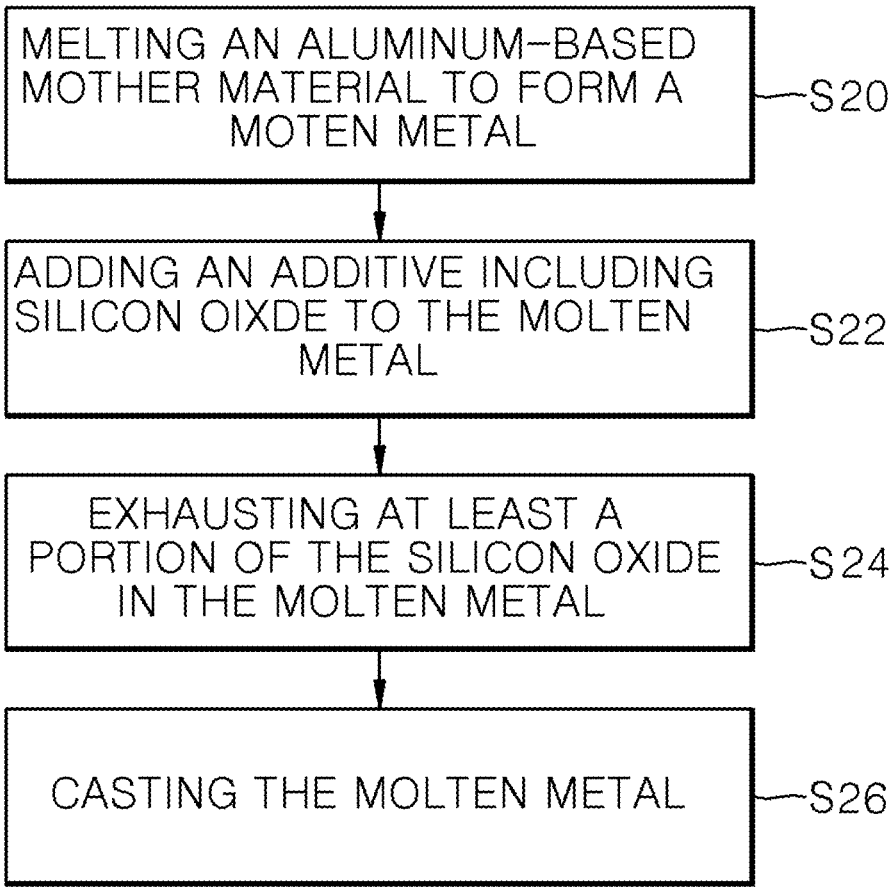
FIG. 1 is a flow diagram showing a method of producing an aluminum alloy in accordance with an exemplary embodiment.

FIG. 1 is a flow diagram showing a method of producing an aluminum alloy in accordance with an exemplary embodiment.

Referring to FIG. 1, an aluminum-based mother material may be melted to form a molten metal (S20). The mother material may include, for example, pure aluminum or an aluminum alloy. The aluminum alloy of the mother material may indicate an alloy in which at least one additive element is added to aluminum that is a main element, and typically indicate an alloy containing another additive element as well as silicon. However, the scope of the present embodiment does not exclude a case where silicon is added as an additive element to the aluminum alloy of the mother material.

The aluminum alloy of the mother material may be any one selected from the group consisting of, for example, 1000 series, 2000 series, 3000 series, 4000 series, 5000 series, 6000 series, 7000 series and 8000 series wrought aluminum alloys, or 100 series, 200 series, 300 series, 400 series, 500 series, and 700 series casting aluminum alloys on the classification derived from the US aluminum association.

In the forming of the molten metal (S20), the mother material may be melted in a proper reaction furnace, for example, in a crucible. The temperature of the crucible may be controlled in consideration of melting temperature, for example, in a temperature range of 600° C. to 900° C. Selectively, the temperature of the crucible may be set to a temperature higher than the melting temperature of the mother material in consideration of a decrease of temperature occurring when an additive element is added. Meanwhile, the melting temperature of the mother material may become lower than the melting temperature of aluminum as most of alloy elements are added, and thus the temperature of the crucible may be controlled to be not higher than 600° C.

The heating of the crucible may be performed by a proper heating means. For example, a resistance heating, an inductively heating, a laser heating, a plasma heating, a hot air blowing heating may be used alone or in combinations for heating of the crucible.

Next, an additive including silicon oxide may be added to the molten metal (S22). The silicon oxide may include, for example, silicon dioxide ($SiO_2$). Such a silicon oxide may be added in the form of powder having a wide surface area for the purpose of enhancement of reactivity. However, the present embodiment is not limited thereof, and the silicon oxide may be added in the form of pellet in which powder is agglomerated so as to prevent powder phase from being dispersed, or in the form of lump.

The size of powder silicon oxide may need to be properly controlled. When the powder particle size is less than 0.1 μm, the powder particles are so fine that they are dispersed by hot air or agglomerated to each other to form an agglomerate and thus they may not be easily mixed with liquid molten metal. Meanwhile, when the powder particle size exceeds 500 μm, the reaction time with molten metal may be excessively increased. However, the powder particle size may be changed depending on a temperature control method of the molten metal, and the present embodiment is not limited thereto.

The amount of silicon oxide may be properly selected according to the use of an aluminum alloy, i.e., an aluminum-silicon-based alloy, to be produced. For example, the amount of silicon oxide may be limited to a range such that the entire portion of the silicon oxide is substantially exhausted in the molten metal. For example, the silicon oxide may be added in a range of 0.001 wt % to 30 wt %, more strictly, in a range of 0.01 wt % to 15 wt %.

The silicon oxide may be added by putting a necessary amount at the same time or by dividing the necessary amount into proper amounts and putting the divided amounts in multi-stage with a constant time difference. When the added silicon oxide is fine powder, the agglomeration possibility of powder may be lowered and the reaction of silicon oxide may be promoted by putting the powder silicon oxide in multi-stage with a constant time difference.

Meanwhile, in another embodiment, the mother material may be melted together with an additive to form a molten metal. In this case, the mother material and the additive may be installed in advance in the crucible. However, since it is difficult to control the form of silicon oxide or adding method in this case, it may be difficult to control a reaction of silicon oxide.

Next, at least a portion of silicon oxide may be exhausted in the molten metal (S24). For example, a portion of silicon oxide may react with molten metal and/or atmosphere and be composed and removed from the molten metal. Further, by activating such a decomposition reaction, the substantial entire portion of the silicon oxide may be decomposed and removed from the molten metal. For example, the reaction of silicon oxide may be promoted by maintaining the molten metal during a predetermined time in a state that the silicon oxide is added or stirring the molten metal. The exhausting operation (S24) may be called a decomposition operation in that the exhaustion of the silicon oxide substantially accompanies the decomposition of the silicon oxide.

Meanwhile, since the exhausting operation (S24) may start substantially at the same time with the above-described adding operation (S22), the exhausting operation (S24) may not substantially discriminate from the adding operation (S22). Further, in the case where the adding of the additive is performed in multi-stage, the adding operation (S22) and the exhausting operation (S24) may be repeatedly performed.

For example, the silicon oxide may be composed into silicon and oxygen. Silicon may remain in the molten metal or react with another alloy element, and oxygen may be substantially removed from the molten metal. For example, oxygen may be mostly discharged in a gate state to the atmosphere through the surface of the molten metal. In the exhausting operation (S24), the surface of the molten metal may be exposed to the atmosphere in order to activate the discharge of oxygen. In another example, oxygen may be removed after being floated as a dross or sludge on the molten metal.

Silicon decomposed from the silicon oxide may remain in the molten metal or may react with another alloy element to form a compound. For example, silicon decomposed in various alloys may remain as a primary silicon or eutectic silicon in the aluminum matrix. In another example, when the aluminum mother material is an aluminum-magnesium alloy, the decomposed silicon may react with magnesium in the molten metal to form a magnesium-silicon compound. For example, the magnesium-silicon compound may include $Mg_2Si$ phase.

The stirring of the molten metal may be performed in various ways. For example, the stirring may be provided through a mechanical stirrer within the molten metal or through an electromagnetic field applying unit around the crucible. The electromagnetic field applying unit may perform the stirring by applying an electromagnetic field in the molten metal to cause convection of the molten metal.

For example, the stirring may start from the adding of an additive or after the additive is added and then a predetermined time elapses. In another example, the stirring may start from the forming of the molten metal. The stirring time may be changed depending on the condition of the molten metal or the amount or form of the additive. For example, the stirring may be performed until the additive is not substantially shown in the surface of the molten metal. However, although the additive is not shown in the surface of the molten metal, since the additive may remain in the molten metal, the stirring may be further performed with spare maintenance time.

Meanwhile, since oxygen is removed from the surface of the molten metal of which a considerable portion contacts the atmosphere in a gas state, it may be effective to stir the upper portion of the molten metal. For example, the stirring may be performed at an upper layer portion from the surface of the molten metal to a point which is not more than 20% of a total depth of the magnesium molten metal, and particularly in a case intended to activate the surface reaction, the stirring may be performed at a surface portion from the surface of the molten metal to a point which is not more than 10% of a total depth of the magnesium molten metal.

Next, the molten metal may be cast (S26) to produce an aluminum alloy. In the casting (S26), the temperature of a mold may be in a range of room temperature (e.g., 25° C.) to 400° C. Also, after the mold is cooled to room temperature, the alloy may be separated from the mold, but when the solidification of the alloy is completed, the alloy may be separated from the mold even at a temperature prior to room temperature.

For example, the mold may be any selected from the group consisting of a metal mold, a ceramic mold, a graphite mold, and equivalents. Also, examples of the casting may include a sand casting, a die casting, a gravity casting, a continuous casting, a low pressure casting, a squeeze casting, a lost wax casting, a thixo casting, and the like.

The gravity casting indicates a method in which a molten alloy is injected into a mold using gravity, and the low pressure casting may indicate a method in which a pressure is applied to a molten metal surface of a molten alloy using a gas to inject the molten metal into a mold. The thixo casting is a casting technique in a semi-molten state, and is a method in which the advantages of typical casting and forging are fused. The scope of the present embodiment is not limited to the types of the above-described molds and the casting methods.

Since the silicon oxide is substantially exhausted in the molten metal, silicon oxide does not substantially exist in the cast aluminum alloy. Alternatively, at least a portion of silicon decomposed from the silicon oxide remains as primary or eutectic silicon within the aluminum matrix, and/or may react with another alloy element to remain in the form of a compound. The silicon remaining in the aluminum matrix may cause a solid-solution strengthening effect to contribute to enhancement of strength of the aluminum alloy.

As described above, when the aluminum mother material includes an aluminum-magnesium alloy, such a compound may include a magnesium-silicon compound, for example, $Mg_2Si$. Therefore, in the casting of an Al—Mg—Si (6000 series) alloy, $Mg_2Si$ phase may be formed without a heat treatment by not separately supplying silicon (Si) but decomposing and supplying silicon oxide in the molten metal. In consideration of the fact that the formation of $Mg_2Si$ phase in 6000 series alloys are typically performed by a heat treatment after casting, it is a surprising fact that $Mg_2Si$ phase in 6000 series alloys may be formed without a heat treatment. Such $Mg_2Si$ phase may induce a secondary phase strengthening effect to contribute to enhancement of strength.

According to the above description, silicon component may be added to an aluminum alloy by adding silicon oxide instead of silicon in an aluminum mother material. The above-described producing method is very economical in that silicon oxide may be obtained more easily and inexpensively in a commercial view than silicon. Moreover, since $Mg_2Si$ phase in casting of anal-Mg—Si-based alloy may be obtained without a heat treatment by using the above-described method, the method is more economical.

As described above, the produced aluminum alloy containing silicon may be applied to various products, and may include an aluminum-silicon (Al—Si)-based alloy, an aluminum-magnesium-silicon (Al—Mg—Si)-based alloy, an aluminum-silicon-copper (Al—Si—Cu)-based alloy, an aluminum-copper-magnesium-silicon (Al—Cu—Mg—Si)-based alloy, and the like. As a wrought material, the aluminum-silicon-based alloy may include 4000 series alloys on the classification derived from the US aluminum association, and the aluminum-magnesium-silicon-based alloy may include 6000 series alloys.

Since silicon does not almost cause a decrease in castability due to addition of a third element, the aluminum alloy containing silicon according to this embodiment may be used as an alloy containing a third element in addition to silicon, for example, a multi-component system alloy, such as Al—Si—Cu, Al—Si—Mg, Al—Si—Cu—Mg, or the like. Such a multi-component system alloy may enhance the mechanical properties by adjusting the amount of the third element to adjust a precipitation hardening effect.

Hereinafter, the present disclosure will be described in more detail through experimental examples of the present disclosure.

Figure 2A:
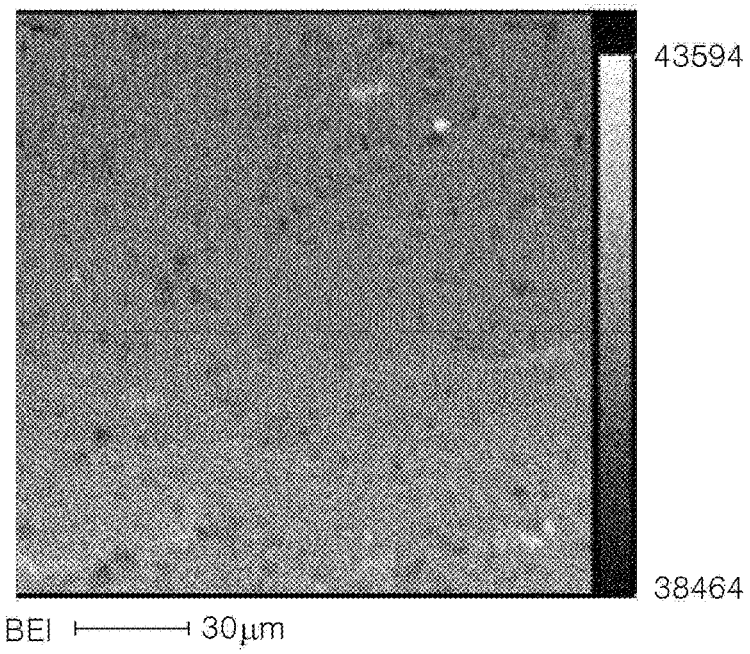
FIGS. 2A through 2D are photographs showing EPMA analysis results of aluminum alloys produced according an experimental example of the present disclosure.
Figure 2B:
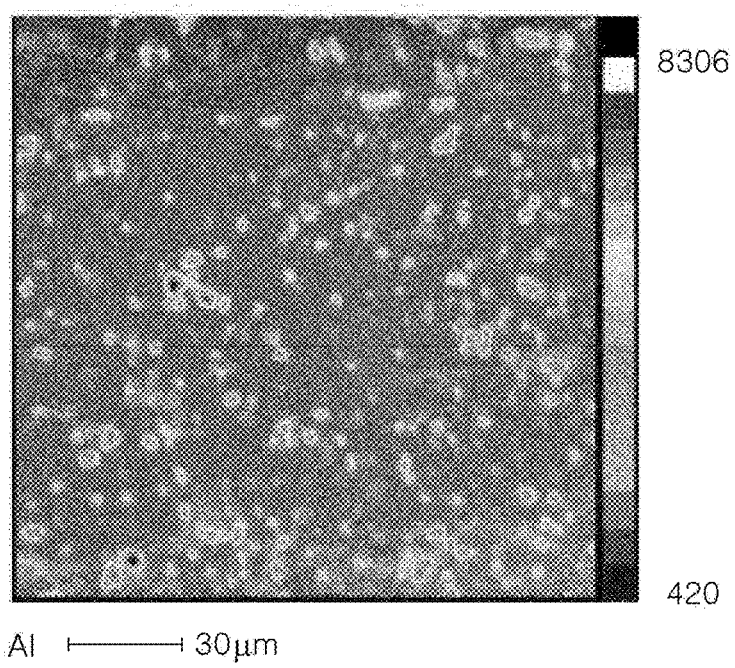
Figure 2C:
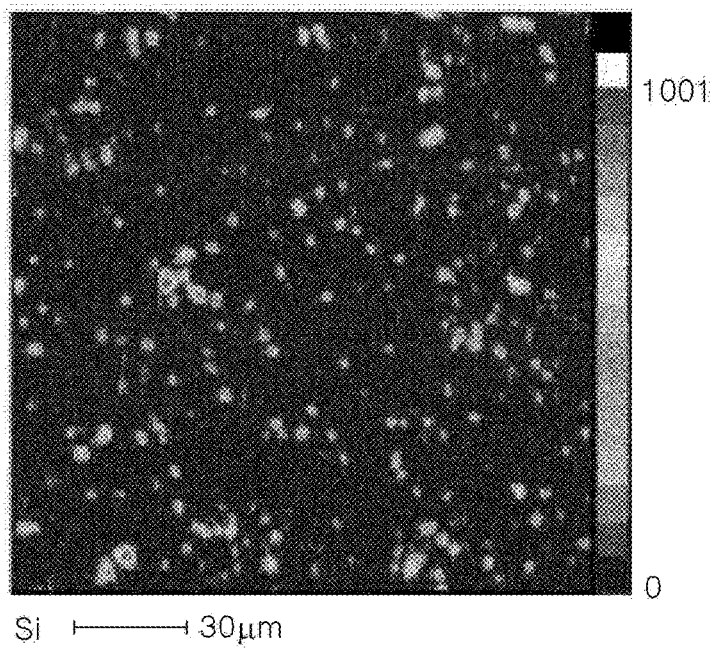
Figure 2D:
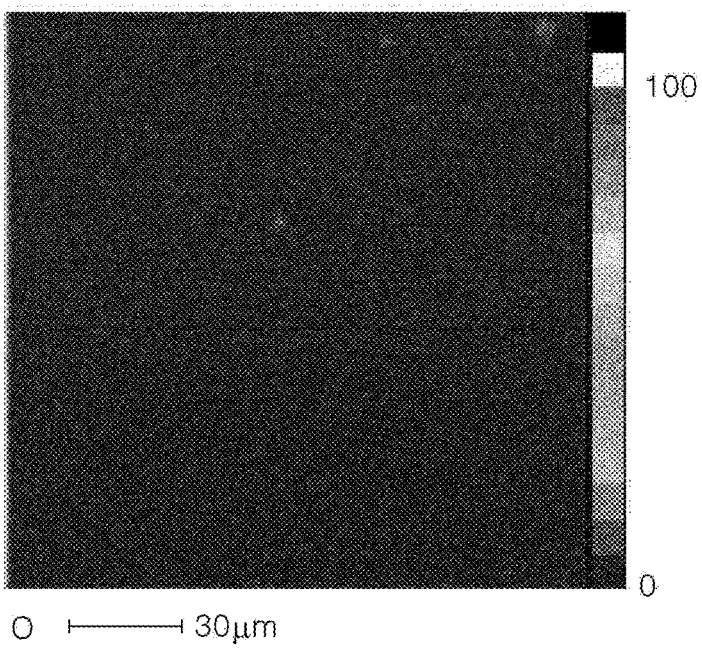

FIGS. 2A to 2D are photographs showing EPMA analysis results of aluminum alloys produced according an experimental example of the present disclosure. FIG. 2A shows a microstructure of an alloy observed using a back scattering electron, and FIGS. 2B to 2D are mapping results by EPMA, and show distributions of aluminum, silicon, and oxygen, respectively.

The aluminum alloy according to the present embodiment was produced by adding a $SiO_2$ additive to a mother material in an amount of about 0.5 wt %. Moreover, stirring is added in a decomposition operation.

Referring to FIG. 2A, it is known that fine crystals are widely distributed in the alloy. Referring to FIGS. 2B and 2C together, it is known that spots are observed at almost the same locations as those in the crystal of FIG. 2A, and the amount of aluminum is low and the amount of silicon is high at the spots. Referring to FIG. 2D, it is known that oxygen is almost not detected overall in the alloy.

From these results, it can be known that the crystals of FIG. 2A are not silicon oxide but silicon crystals. Therefore, it can be known that silicon is widely distributed in a matrix of the aluminum alloy produced according to this experimental example and silicon oxide is almost substantially decomposed and does not remain.

Figure 3:
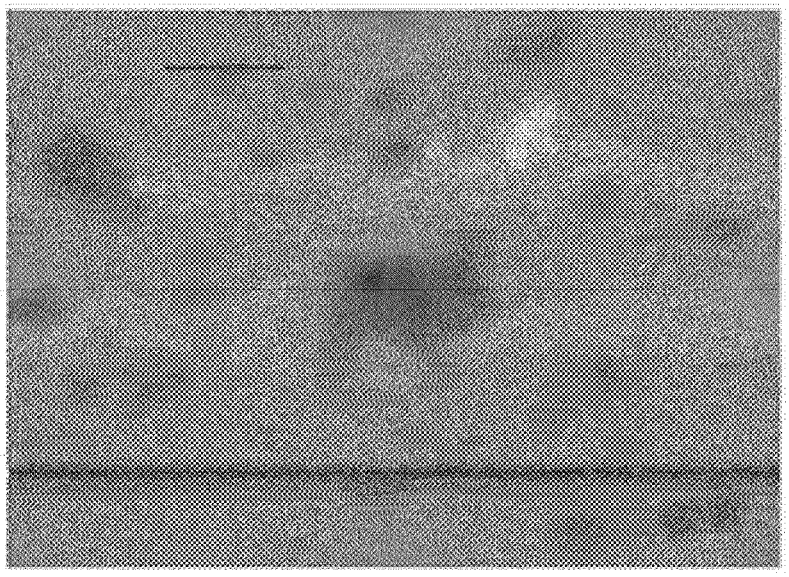
FIG. 3 is a photograph showing a point analysis result of an aluminum alloy produced according to an experimental example of the present disclosure.

FIG. 3 is a photograph showing a point analysis result of an aluminum alloy produced according to an experimental example of the present disclosure.

Table 1 below shows component analysis results (wt %) of point 1 to point 5 of FIG. 3.

TABLE 1

| | Al | Si | O | Sum |
|---|---|---|---|---|
| Point 1 | 70.523 | 29.477 | 0 | 100 |
| Point 2 | 61.514 | 38.486 | 0 | 100 |
| Point 3 | 63.742 | 36.258 | 0 | 100 |
| Point 4 | 100 | 0 | 0 | 100 |
| Point 5 | 100 | 0 | 0 | 100 |

From FIG. 3 and Table 1, it can be known that points 1 to 3 substantially indicate a silicon crystal grain on an aluminum matrix, and points 4 and 5 substantially indicate an aluminum matrix.

Figure 4A:
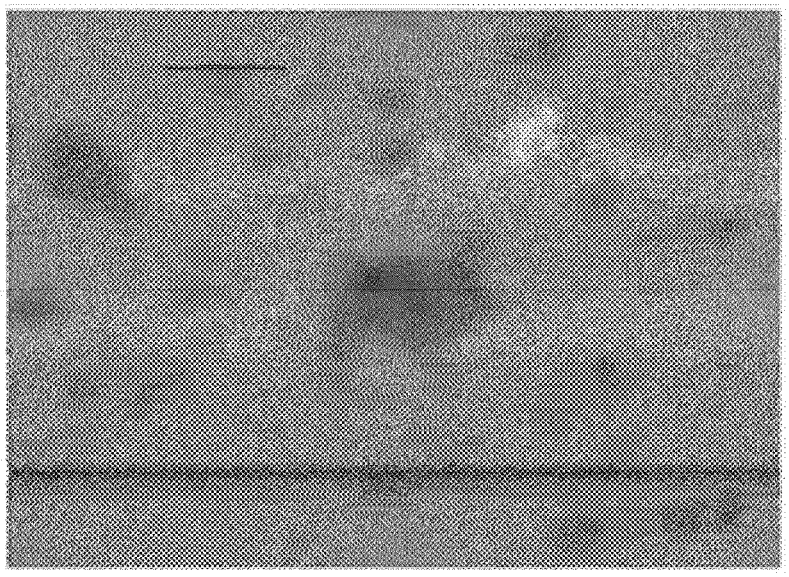
FIG. 4A is a photograph for a line analysis of an aluminum alloy produced according to an experimental example of the present disclosure.
Figure 4B:
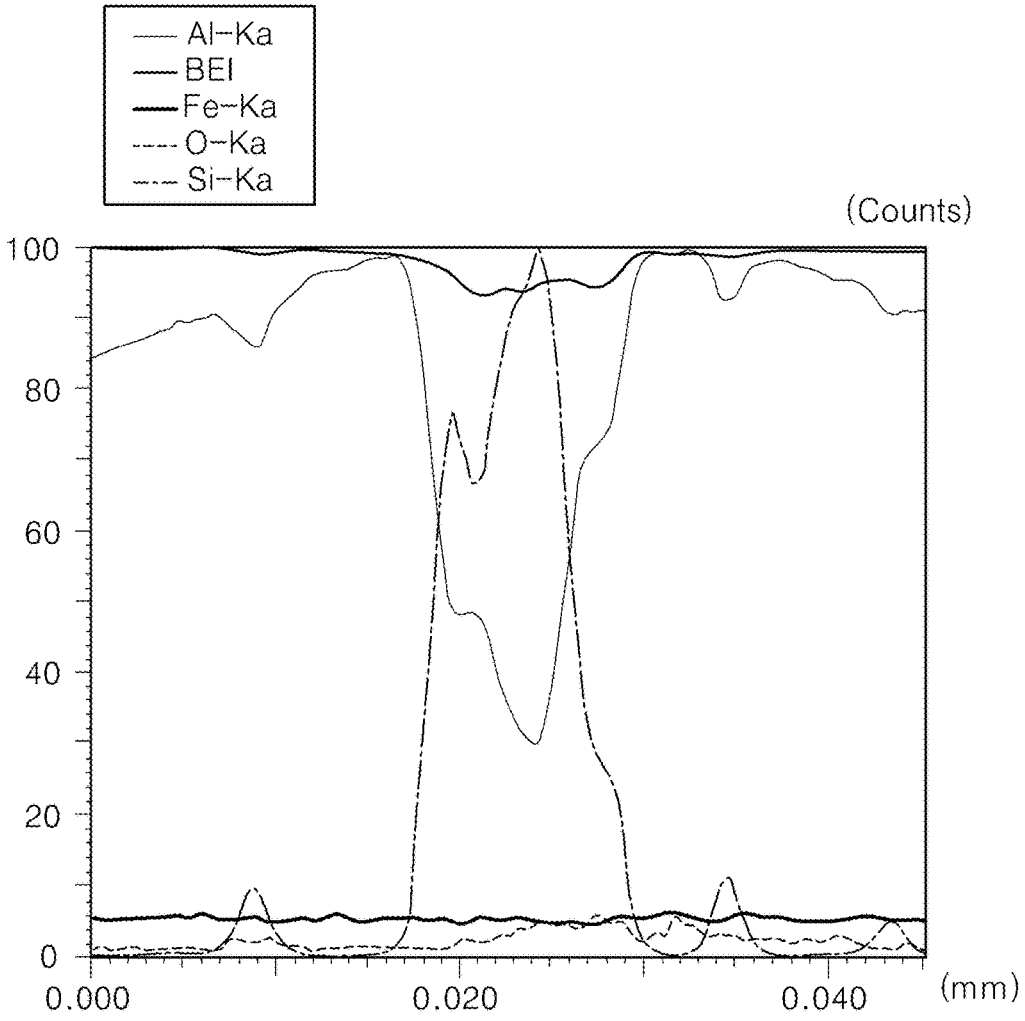
FIG. 4B is a graph showing a component profile according to the line analysis of the aluminum alloy of FIG. 4A.

FIG. 4A is a photograph for a line analysis of an aluminum alloy produced according to an experimental example of the present disclosure. FIG. 4B is a graph showing a component profile according to the line analysis of the aluminum alloy of FIG. 4A.

Referring to FIGS. 4A and 4B, it can be known that the amount of aluminum decreases at a portion of a grain and the amount of silicon is observed in the form of a peak. Also, it can be known that oxygen is almost not observed in the entire range of the line. From this, it can be known that the grain is substantially comprised of silicon.

Figure 5A:
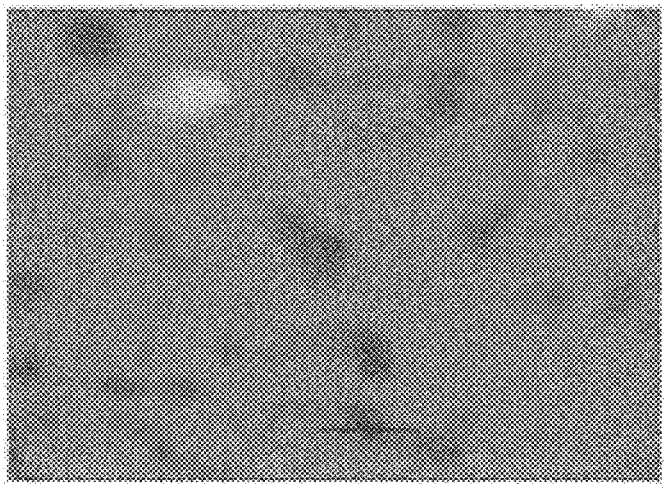
FIG. 5A is a photograph for a line analysis of an aluminum alloy produced according to an experimental example of the present disclosure.
Figure 5B:
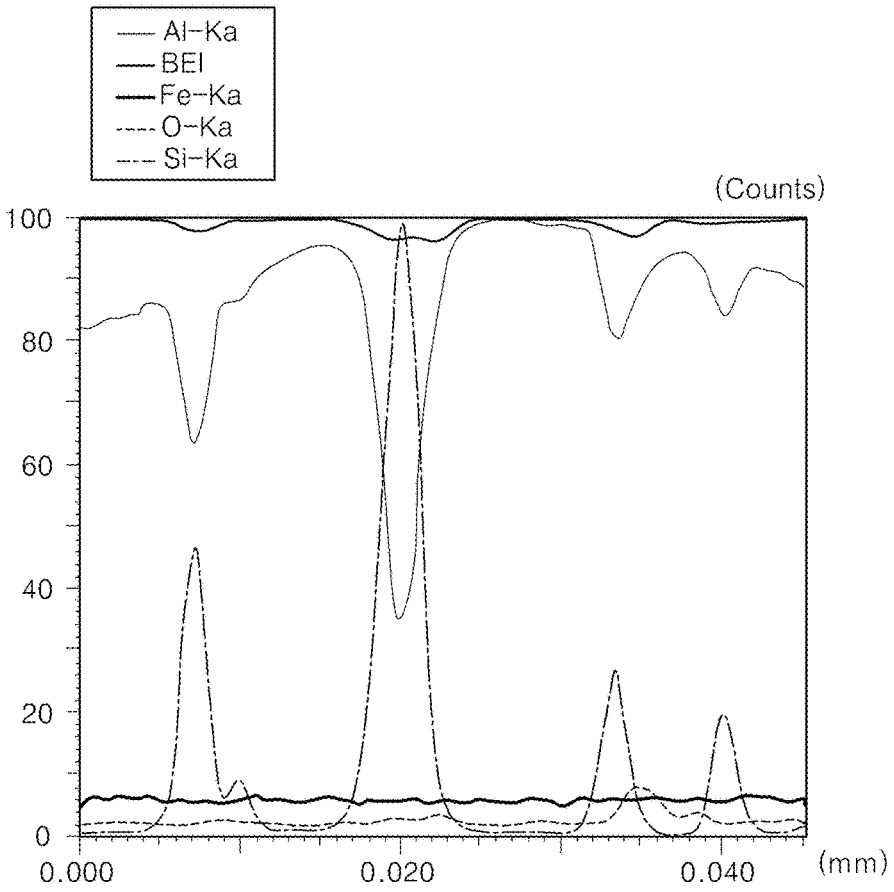
FIG. 5B is a graph showing a component profile according to the line analysis of the aluminum alloy of FIG. 5A.

FIG. 5A is a photograph for a line analysis of an aluminum alloy produced according to an experimental example of the present disclosure. FIG. 5B is a graph showing a component profile according to the line analysis of the aluminum alloy of FIG. 4A.

Referring to FIGS. 5A and 5B, it can be known that the amount of aluminum decreases at a portion of a grain and the amount of silicon is observed in the form of a peak. Also, it can be known that oxygen is almost not observed in the entire range of the line. From this, it can be again confirmed that the grain is substantially comprised of silicon.

Figure 6:
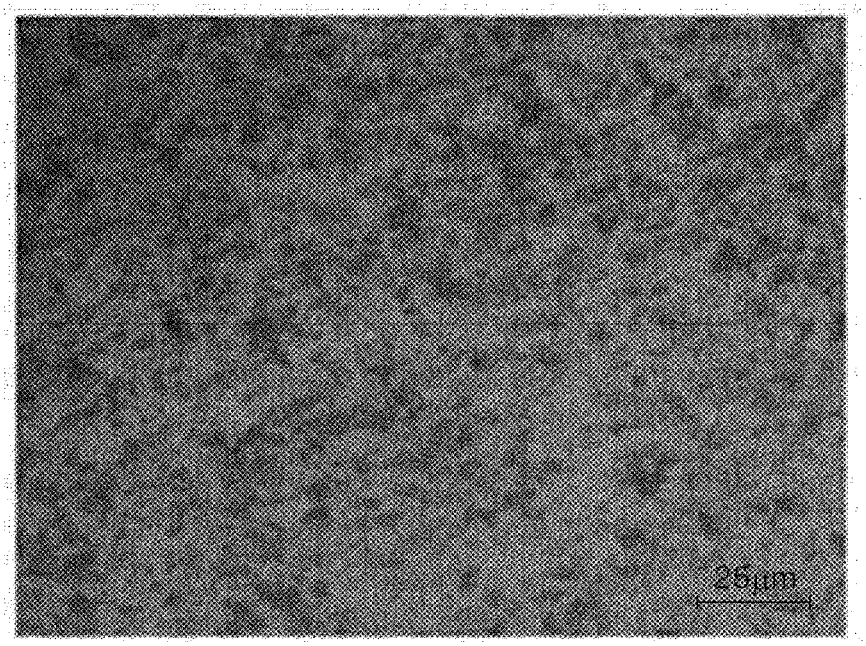
FIG. 6 is a photograph showing a texture distribution of an aluminum alloy produced according to an experimental example of the present disclosure.

FIG. 6 is a photograph showing a texture distribution of an aluminum alloy produced according to an experimental example of the present disclosure.

Referring to FIG. 6, it can be known that silicon crystal grains are finely distributed as indicated by arrow in an aluminum matrix. Meanwhile, it is understood that the high silicon amount in the surface of the alloy compared to the amount of $SiO_2$ is due to the silicon amount in the surface of the alloy being increased by stirring. From this, it is determined that the silicon amount in the surface portion of the alloy is higher than that in a core portion of the alloy.

FIGS. 7A through 7D are photographs showing EPMA analysis results of aluminum alloys produced according another experimental example of the present disclosure. FIG. 2A shows a microstructure of an alloy observed using a back scattering electron, and FIGS. 2B through 2D are mapping results by EPMA, and show distributions of aluminum, silicon, and oxygen, respectively.

The aluminum alloy according to the present embodiment was produced by adding a $SiO_2$ additive to a mother material in an amount of about 0.5 wt %. Meanwhile, the decomposing operation was performed without stirring.

Figure 7A:
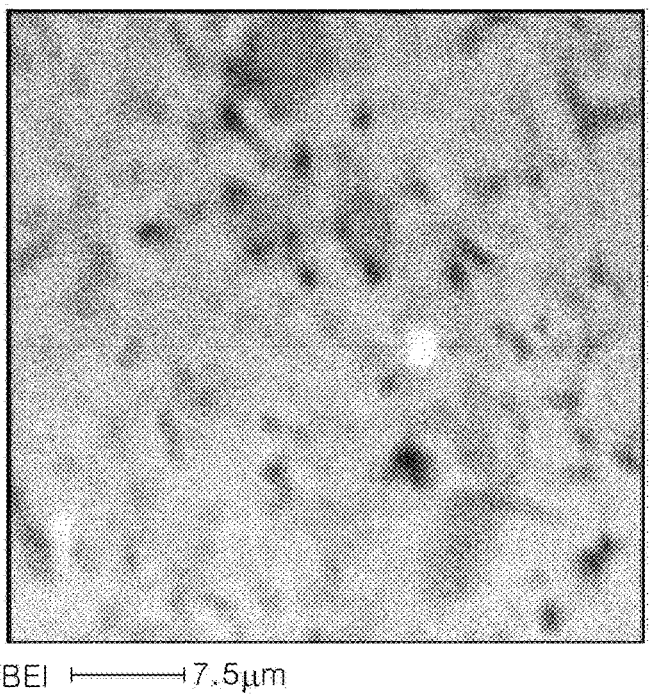
FIGS. 7A through 7D are photographs showing EPMA analysis results of aluminum alloys produced according another experimental example of the present disclosure.
Figure 7B:
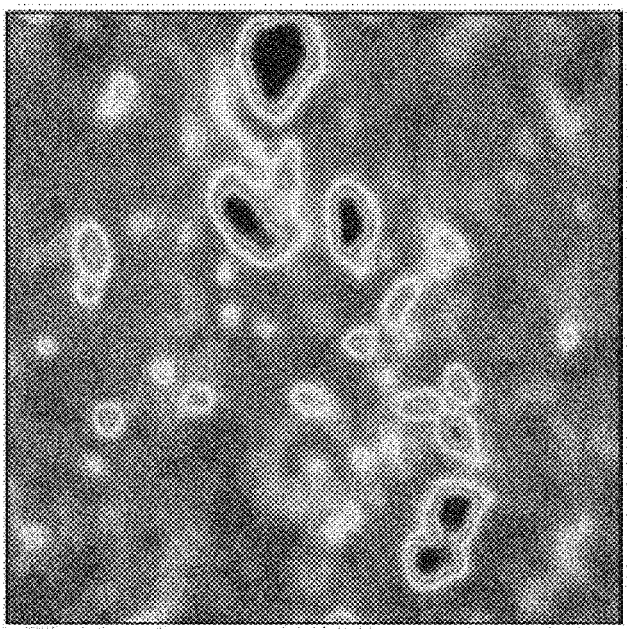
Figure 7C:
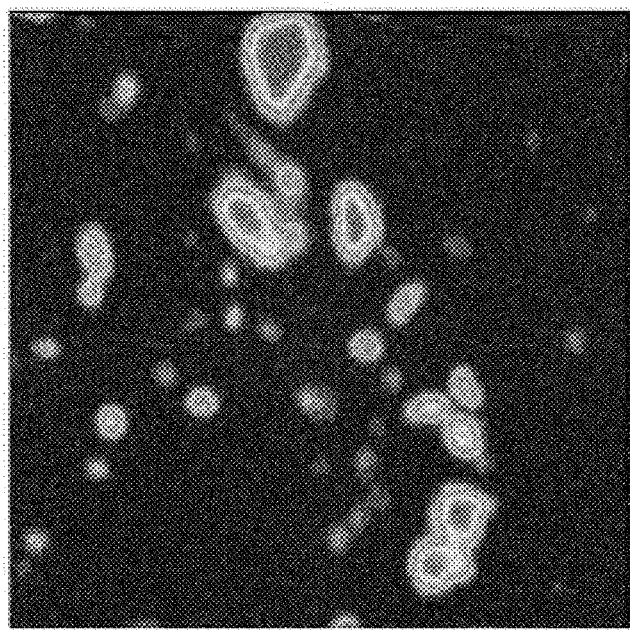
Figure 7D:
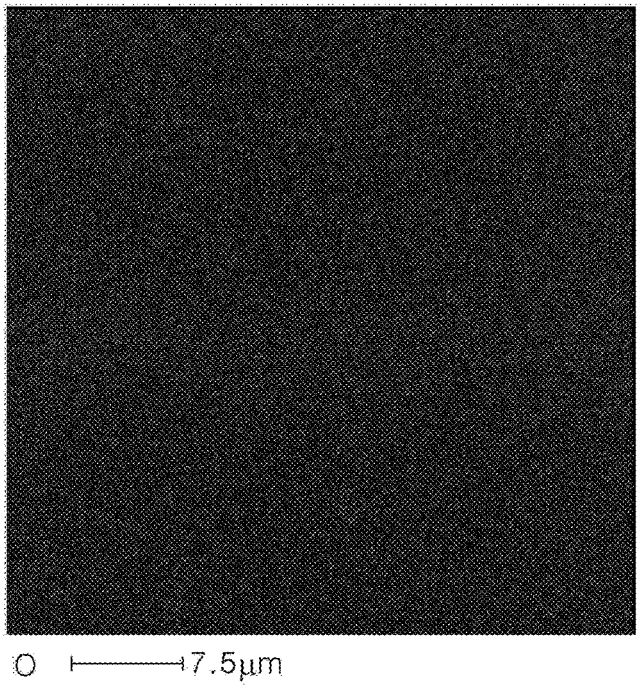

Referring to FIG. 7A, it is known that fine crystal grains are widely distributed in the alloy. Referring to FIGS. 7B and 7C together, it is known that spots are observed at almost the same locations as those in the crystal grains of FIG. 2A, and the amount of aluminum is low and the amount of silicon is high at the spots. Referring to FIG. 7D, it is known that oxygen is almost not detected overall in the alloy.

From these results, it can be known that the crystal grains of FIG. 7A are not silicon oxide but silicon crystals. Therefore, it can be known that silicon is widely distributed in a matrix of the aluminum alloy produced according to this experimental example and silicon oxide is almost substantially decomposed and does not remain.

Figure 8:
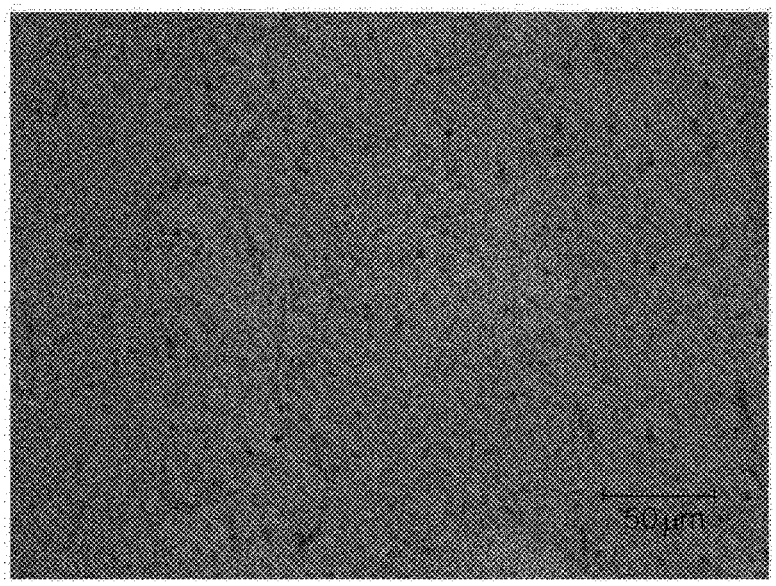
FIG. 8 is a photograph showing a texture distribution of an aluminum alloy produced according to another experimental example of the present disclosure.
Figure 9:
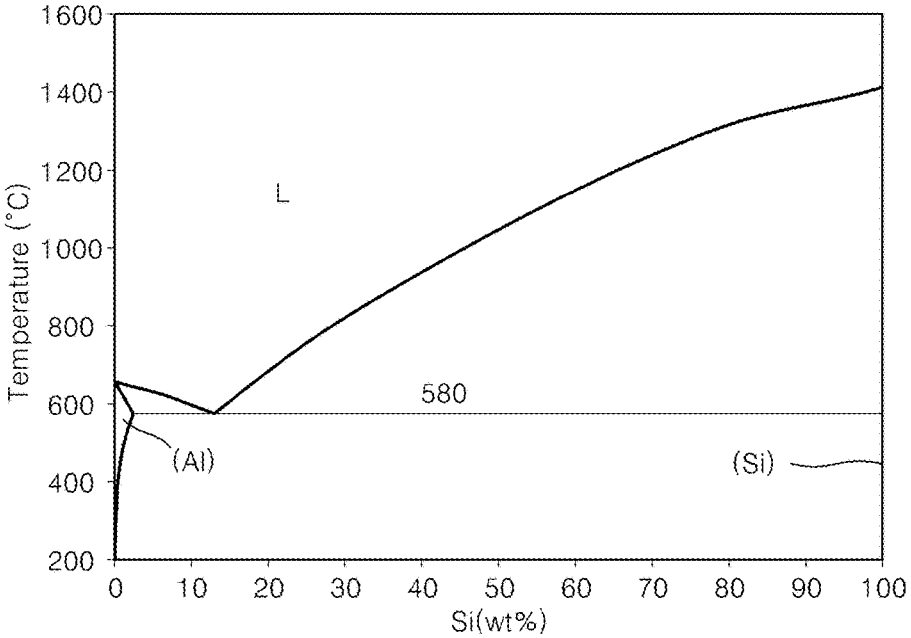
FIG. 9 is a graph showing a phase diagram of an aluminum-silicon alloy.

FIG. 8 is a photograph showing a texture distribution of an aluminum alloy produced according to another experimental example of the present disclosure.

Referring to FIG. 8, it can be known that silicon crystal grains are finely distributed as indicated by arrow in an aluminum matrix. Meanwhile, as compared with FIG. 6, it can be known that the density of silicon crystal grains in FIG. 8 is lower than that in FIG. 6. From this, it can be known that when stirring is performed, a reaction is activated at a surface portion of the molten metal and thus the silicon amount in the surface portion of the alloy increases.

Figure 10A:
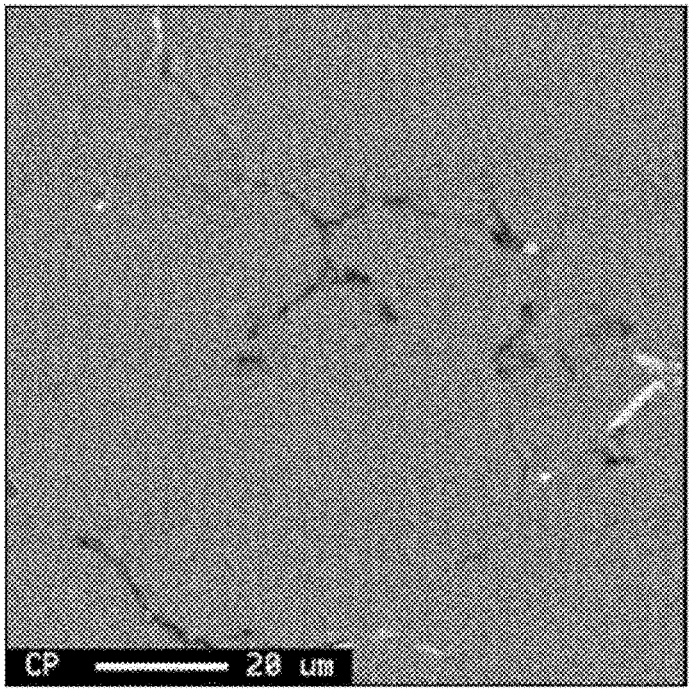
FIGS. 10A-10D are photographs showing EPMA analysis results of aluminum alloys produced according to another experimental example of the present disclosure.
Figure 10B:
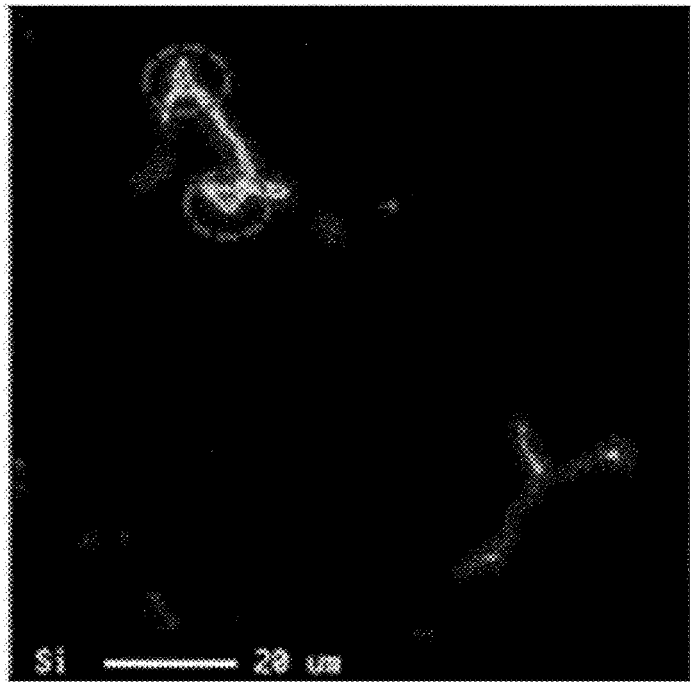
Figure 10C:
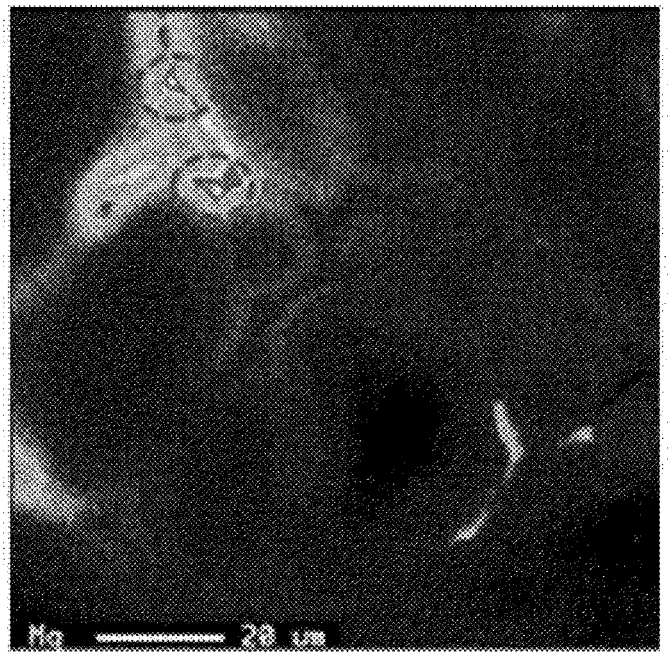
Figure 10D:
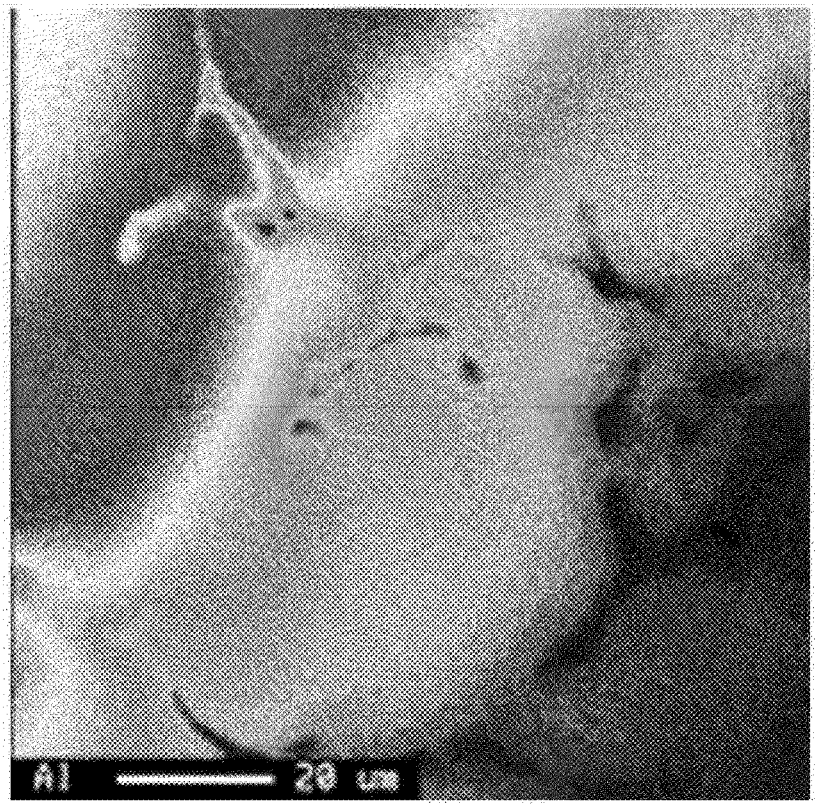

FIGS. 10A through 10D are photographs showing EPMA analysis results of aluminum alloys produced according another experimental example of the present disclosure. FIG. 10A shows a microstructure of an alloy observed using a back scattering electron, and FIGS. 10B to 10D are mapping results by EPMA, and show distributions of silicon, magnesium, and aluminum, respectively. The aluminum alloy according to this experimental example was produced by adding a $SiO_2$ additive to a mother material in an amount of about 0.5 wt %.

Referring to FIGS. 10A through 10D, it can be known that crystal grains are distributed in the alloy. As shown in FIGS. 10B and 10C, it can be known that Mg and Si are observed at the same region at the same time. Therefore, it can be known that the crystal grains within the region represented by a dotted line are a magnesium-silicon compound, typically, $Mg_2Si$. Accordingly, it can be known that silicon decomposed from silicon oxide added as an additive in the production of the alloy reacts with an alloy element, for example, magnesium to form a magnesium-silicon compound.

By the producing method in accordance with an exemplary embodiment, silicon component can be added to an aluminum alloy by adding silicon oxide instead of silicon to an aluminum-based mother material. The above-described producing method is economical in that silicon oxide may be obtained easily and inexpensively in a commercial view.

The descriptions for the specific embodiments of the present disclosure are provided for the purpose of illustration and explanation. Therefore, it will be understood by those of ordinary skill in the art that various modifications and changes, such as combinations of the embodiments may be made therein without departing from the technical spirits and scope of the present invention.

What is claimed is:

1. A method of producing an aluminum alloy, comprising:
melting an aluminum-based mother material to form a molten metal;
adding a silicon oxide to the molten metal;
exhausting at least a portion of the silicon oxide in the molten metal; and
casting the molten metal,
wherein the exhausting comprises stirring an upper portion of the molten metal,
wherein the stirring is performed in a state that the surface of the molten metal is exposed to an atmosphere, and
wherein the stirring is performed at an upper layer portion from a surface of the molten metal to a point which is not more than 20% of a total depth of the molten metal.

2. The method of claim 1, wherein the exhausting is performed such that the entire portion of the silicon oxide does not remain in the molten metal.

3. The method of claim 2, wherein in the exhausting, the silicon oxide is decomposed into silicon, and at least a portion of the silicon is distributed in an aluminum matrix of the aluminum alloy.

4. The method of claim 1, wherein the exhausting is performed such that oxygen generated from decomposition of the silicon oxide is removed from the molten metal.

5. The method of claim 4, wherein the oxygen is removed in the form of a gas through a surface of the molten metal.

6. The method of claim 4, wherein the oxygen is transformed to the form of dross or sludge and then removed.

7. The method of claim 1, wherein the silicon oxide is decomposed from a surface portion of the molten metal by the stirring.

8. The method of claim 1, wherein an added amount of the silicon oxide is limited to a range that the silicon oxide is all exhausted in the molten metal and does not remain in the aluminum alloy.

9. The method of claim 8, wherein the added amount of the silicon oxide is in a range of 0.001 wt % to 30 wt %.

10. The method of claim 1, wherein the mother material comprises aluminum or an aluminum alloy.

11. The method of claim 1, wherein the mother material comprises an aluminum-magnesium alloy, the silicon oxide is decomposed by the exhausting to produce silicon, and at least a portion of the silicon reacts with magnesium in the molten metal to form a magnesium-silicon compound.

12. The method of claim 11, wherein the magnesium-silicon compound comprises $Mg_2Si$.

13. A method of producing an aluminum alloy, comprising:
melting an aluminum-based mother material to form a molten metal;
adding a silicon oxide to the molten metal;
decomposing the substantial entire portion of the silicon oxide in the molten metal to remain silicon in the molten metal and remove oxygen from the molten metal,
wherein the decomposing comprises stirring an upper portion of the molten metal,
wherein the stirring is performed in a state that the surface of the molten metal is exposed to an atmosphere,
wherein the stirring is performed at an upper layer portion from a surface of the molten metal to a point which is not more than 20% of a total depth of the molten metal, and
an added amount of the silicon oxide is in a range of 0.001 wt % to 30 wt %; and
casting the molten metal such that at least a portion of the silicon is distributed in an aluminum matrix and the silicon oxide does not substantially remain.

* * * * *